United States Patent [19]

Schummer et al.

[11] 4,329,170

[45] May 11, 1982

[54] METHOD OF TREATING SULFUR-CONTAINING METALLURGICAL MATERIALS

[75] Inventors: Anton Schummer; Uwe-Jens Hansen; Michael Kopke, all of Hamburg, Fed. Rep. of Germany

[73] Assignee: Norddeutsche Affinerie, Hamburg, Fed. Rep. of Germany

[21] Appl. No.: 74,299

[22] Filed: Sep. 11, 1979

[30] Foreign Application Priority Data

Sep. 13, 1978 [DE] Fed. Rep. of Germany ..... 2839794

[51] Int. Cl.[3] ..... C22B 15/00

[52] U.S. Cl. ..... 75/23; 75/74; 75/92

[58] Field of Search ..... 75/23, 72, 73, 74, 92, 75/117

[56] References Cited

U.S. PATENT DOCUMENTS

| | | | |
|---|---|---|---|
| 1,459,084 | 6/1923 | Bezanson | 423/540 |
| 3,004,846 | 10/1961 | Queneau | 75/23 |
| 3,154,411 | 10/1964 | Back et al. | 75/107 |
| 3,796,568 | 3/1974 | Szekely et al. | 75/74 |
| 4,148,630 | 4/1979 | Arentzen | 75/74 |
| 4,165,979 | 8/1979 | Davies et al. | 75/74 |

FOREIGN PATENT DOCUMENTS

| | | | |
|---|---|---|---|
| 449954 | 12/1974 | U.S.S.R. | 75/74 |

*Primary Examiner*—M. J. Andrews
*Attorney, Agent, or Firm*—Karl F. Ross

[57] ABSTRACT

In the processing of sulfur-containing metallurgical intermediates, sulfide ores or ore concentrates at a flame temperature of at least 1500° C. in which sulfur dioxide and a melt are formed, acid sludge from the acid treatment of petroleum and mineral oils is substituted for at least a portion of the fuel. The acid sludge contains at most 85% by weight of inorganic components and is preferably introduced through a lance together with the combustion-sustaining gas and any additional fuel, usually in the form of oil.

8 Claims, 3 Drawing Figures

METHOD OF TREATING SULFUR-CONTAINING METALLURGICAL MATERIALS

FIELD OF THE INVENTION

The present invention relates to a method of treating sulfur-containing metallurgical materials and, more particularly, to a process for the flame treatment of metallurgical intermediates, sulfidic ores and sulfur-containing ore concentrates to reduce the sulfur level in the resulting residue or metallurgical product.

BACKGROUND OF THE INVENTION

The flame treatment of metallurgical intermediates, sulfidic ores and/or sulfur-containing ore concentrates in the presence of oxygen-containing gases and at roasting or higher temperatures is a well known expedient to recover a residue or metallurgical product having a reduced sulfur content by, in part, the transformation of the sulfur originally contained in the metallurgical material into sulfur dioxide.

When the treatment is carried at high flame temperatures, e.g. of at least 1500° C., the product or residue can be recovered in a molten phase and practically all of the sulfur is discharged in the form of sulfur dioxide.

These processes are not generally autogenous and thus may require the supply of fuel to the system. The process can be carried out in reverberatory hearth furnaces, short-drum furnaces and rotary kilns or drum furnaces.

Of particular interest as to such flame treatments are flash or suspension smelting or reverberatory-furnace smelting of the raw material which can be enriched in ore and to which fluxes can be added. These systems make use of fuels and produce a "concentrate", e.g. a copper matte, containing various levels of nickel, zinc and lead sulfide depending upon the source of the feed, i.e. the starting metallurgical material (see Meyers *Lexikon der Technik und der exakten Naturwissenschaften,* Bibliographisches Institut, Mannheim, Germany; Wien, Austria; Zürich, Switzerland; Vol. 3, p. 2308; Winnaker and Küchler, Chemische Technologie, Vol. 6, pp. 228/229, Carl Hanser Verlag, München, Germany 1973.)

A disadvantage of these processes, however, is that without the added fuel in considerable quantities the desired or necessary reaction temperatures cannot always be attained or sustained, the quantity of fuel which is necessary being dependent upon the nature of the feed. Consequently the process cannot always be carried out economically.

OBJECTS OF THE INVENTION

It is the principal object of the present invention to provide an economical process for the treatment of sulfur-containing metallurgical materials.

Another object of our invention is to provide an improved process for the flame treatment of metallurgical intermediates, sulfidic ores and sulfur-containing ore concentrates which is free from the disadvantages of the earlier techniques and which transforms practically all of the sulfur into sulfur dioxide and to yield a molten metallurgical product, but which is free from corrosion problems and other disadvantages heretofore encountered in the flame treatment of such materials.

Still another object of the invention is to reduce the fuel cost of a method of flame treating metallurgical materials.

SUMMARY OF THE INVENTION

These objects and others which will become apparent hereinafter are attained, in accordance with the present invention, in a process for the flame treatment of metallurgical materials, namely, sulfur-containing material intermediates, ores and ore concentrates, using a combustion-generated flame formed in the presence of oxygen-containing combustion-sustaining gases, in which the flame is generated at least in part by the combustion of an acid sludge derived from the acid treatment of petroleum products or mineral oils and containing at most 85% by weight inorganic components.

In other words, in accordance with the present invention, at least part of the fuel necessary for the flame treatment of the metallurgical materials is replaced by the acid sludge which can contain at most 85% by weight of the inorganic substance.

The acid sludge used in accordance with the present invention is a waste product produced by the refining of mineral oils in part by a treatment thereof with sulfuric acid.

Difficulties have been encountered heretofore in the further process of such sludges because their disposal poses an environmental hazard. For example, it is known to subject the acid sludge by thermal decomposition to cracked coke and sulfur dioxide (German Pat. No. 15 71 664) or to burn the acid sludge in combustion chambers of the type used to burn elemental sulfur or pyrites or other sulfur-containing materials (U.S. Pat. No. 1,459,084).

A process in which the acid sludge and low-carbon waste sulfuric acid are treated to recover sulfur dioxide or sulfuric acid or oleum is described in German Pat. No. 960,184 and Austrian Pat. No. 254,220. In these systems, as in the others discussed above, except where cracked coke is obtained, the organic components of the acid sludge are not fully burned and large quantities of sulfur trioxide are evolved.

From the foregoing, therefore, it will be apparent that even the disposal of acid sludge or the treatment thereof in an economical fashion have not been fully successful heretofore.

The disadvantages of the earlier acid-sludge treatment processes do not arise with the method of the present invention in which the combustion of the acid sludge contributes to maintaining a flame temperature above 1500° C. Under these circumstances, the organic components of the acid sludge are completely burned and, because of the high flame temperatures, the resulting gas is virtually free from sulfur trioxide.

The invention is used for the processing of intermediates metallurgical products, sulfide ores and/or ore concentrates which involve the formation of molten phases and sulfur dioxide-containing exhaust gases. These methods include particularly flash or reverberatory smelting and methods carried out in hearth furnaces, short-drum furnaces and rotary-drum furnaces.

The acid sludge may be fed through conventional burners designed for liquids of high viscosity, particularly through atomizing burners. Because acid sludge tends to coke at elevated temperatures and is hardly pumpable at normal temperatures, it is preferable to use a feeding lance, which comprises an inner tube for the acid sludge, a surrounding inner annular passage for a temperature-control fluid, such as water, and an annular passage for the atomizing fluid. By the temperature control at the burner tip, the corrosion at that point can be decisively decreased. It is desirable to use a plurality of lances, which may be supplied via an annular manifold.

The feed rate of the acid sludge is controlled by means of a speed-controlled gear pump, which is in series with a flow meter or is connected to a pressure gauge. A feedback control system can be set up in this way.

The quantity of acid sludge used to replace at least part of the fuel is determined by the calorific values of both materials. For instance, heavy fuel oil has a calorific value of 40,100 kJ/kg and acid sludge containing 50% by weight of sulfuric acid and 50% by weight of hydrocarbons has a calorific value of 18,800 kJ/kg.

With respect to the acid sludge, the calorific value which is actually available is stated; i.e. the heat required to decompose the sulfur compounds has been deducted. In view of the above, one unit of weight of fuel oil must be replaced by 2.13 units of weight of acid sludge. This ratio increases as the sulfuric acid content increases and the carbon content decreases, and the ratio decreases as the sulfuric acid content decreases and the carbon content increases.

As is shown in the graph hereof, the calorific value of the acid sludge in megajoules per kilogram (MJ/kg) can be plotted against its sulfuric acid content. The spreading of the curve is due to the different nature of different acid sludges, particularly to their different contents of organic sulfur compounds, which require heat for their decomposition, just as does the sulfuric acid.

The stoichiometric combustion of fuel oil or acid sludge of the above-mentioned quality together with air results in theoretical combustion temperatures of 2100° C. (fuel oil) or 1900° C. (acid sludge). The exhaust gases formed by the combustion of acid sludge have higher sulfur dioxide and water vapor partial pressure than the exhaust gases formed by the combustion of fuel oil. This increases the intensity of radiation so that the lower flame temperature only influences the heat transfer between the flame and the feed to a small degree.

When fuels are replaced particularly by low-hydrocarbon acid sludge, the exhaust gas rate will be increased by several one-tenths of one percent. In existing plants in which the system for handling the fuel gases is used to full capacity even when only fuel is added, the feeding of intermediate metallurgical products, sulfide ores and/or ore concentrates at unchanged rates could result in an exhaust gas rate which is in excess of the gas-handling capacity and could not be handled. This could be avoided only if the throughput of the feed is decreased.

In order to avoid this disadvantage, it is preferred, according to the invention, that the oxygen content in the oxygen-containing oxidizing fluid that is supplied be controlled in dependence on the proportion of acid sludge in such a manner that the exhaust gas rate is not higher than when no fuel is replaced. A constant exhaust gas rate will be obtained if the oxygen content of that part of the oxidizing fluid that is used for the combustion of the acid sludge is selected in accordance with the formula $$X = \frac{MO_2}{\frac{S_{MA} \times H_{uS}}{H_{uB}} - M_A + MO_2}$$

wherein $X$ = the oxygen content of the oxidizing fluid used for the combustion of the acid sludge ($m^3$ $O_2/m^3$ fluid);

$MO_2$ = the oxygen requirement for the combustion of the acid sludge ($m^3$ $O_2$/kg acid sludge)

$M_A$ = the rate of exhaust gas formed by the combustion of acid sludge with pure oxygen ($m^3$/kg acid sludge);

$H_{uS}$ = lower calorific value of the acid sludge (actually available) for the heat of decomposition (kJ/kg acid sludge)

$H_{uB}$ = the lower calorific value of the previously used fuel (kJ/kg fuel)

$S_{MA}$ = the specific rate of exhaust gas formed by the combustion of the previously used fuel ($m^3$/kg of fuel) ($m^3$ always refers to the volume under standard conditions.)

Whereas the combustion of heavy fuel oil having a calorific value of 40,100 kJ/kg results in about 11.3 $m^3$ of exhaust gas per kg, the rates of exhaust gas formed by the combustion of a given acid sludge with pure oxygen and the oxygen rate required for the combustion can be derived from the graph or ascertained empirically by preliminary tests.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
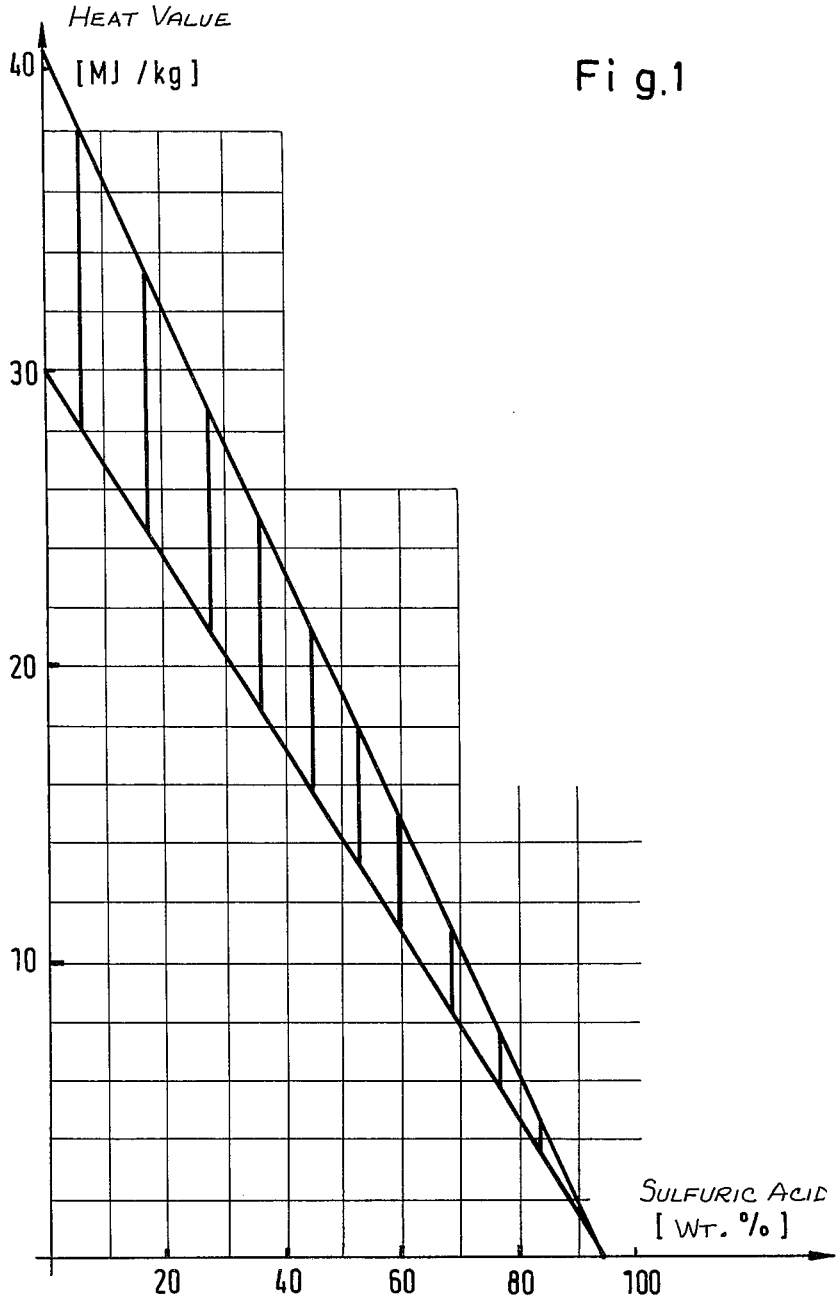
FIG. 1 is a graph illustrating relationships important to the invention.

As has been stated earlier, the calorific value of the acid sludge, in megajoules per kilogram (MJ/kg), is plotted in FIG. 1 against its sulfuric acid content. The spreading of the curve is due to the different natures of different acid sludges, particularly their different contents of organic compounds which require heat for their decomposition.

It is also apparent from the graph that an acid sludge which contains more than 85% by weight of inorganic constituents has virtually no calorific value at all and for this reason cannot be used in the method according to the invention.

Figure 2:
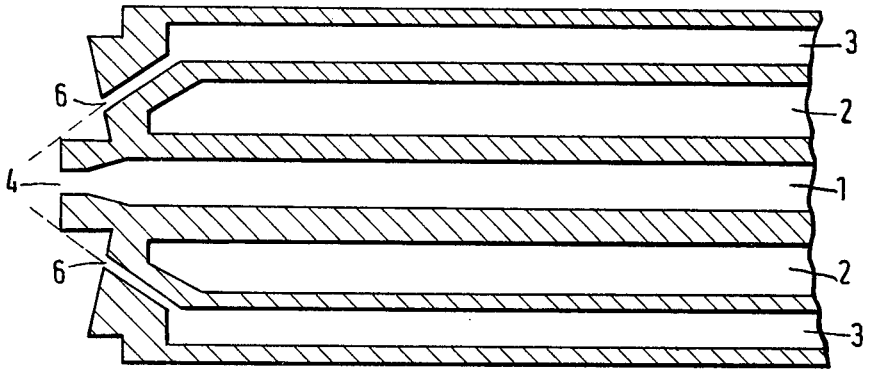
FIG. 2 is an axial cross-sectional view through a burner or lance used with the acid sludge of the invention.
Figure 3:
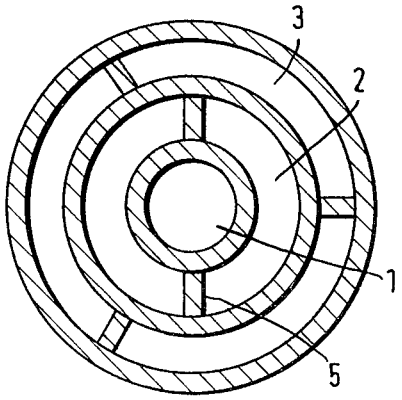
FIG. 3 is a transverse cross-sectional view through this burner or lance.

FIGS. 2 and 3 show a lance which is preferably used to feed the acid sludge. It comprises an inner tube 1 for the acid sludge, an inner annular temperature control passage 2 and an outer passage 3 for feeding the atomizing fluid. The diameter of the inner tube 1 is chosen to avoid clogging. Only the exit cross-section 4 of the inner tube 1 is restricted so that the acid sludge jet can exit at a velocity of up to 10 m/sec. The inner annular passage 2 for the temperature control fluid is divided by a continuous partition 5 into forward and return portions. A control of the temperature at 30° to 80° C. will ensure that the acid sludge can be pumped satisfactorily and that coking and a corrosion of the lance material are excluded.

The outer annular passage 3 is preferably supplied with compressed air or steam as an atomizing fluid. The latter exits through an annular series of bores 6, which are directed toward the acid sludge jet. The atomizing fluid may exit almost at sonic velocity. The bores 6 may consist of Laval nozzles so that the atomizing fluid exits at a supersonic velocity.

SPECIFIC EXAMPLE

A flash-smelting furnace having a throughput capacity of 50 metric tons of copper concentrate per hour had previously been operated with an addition of 2100 kg heavy fuel oil per hour. The fuel oil was fed at a rate of 750 kg/h through a plurality of burners mounted on the shaft and at a rate of 1350 kg/h through a plurality of burners mounted on the lower part of the furnace.

In accordance with the method of the invention, 500 kg/h heavy fuel oil were replaced by 1600 kg/h acid sludge. The furnace was thus fed with 1600 kg/h heavy fuel oil and 1600 kg/h acid sludge.

Through burners, 620 kg/h of the heavy fuel oil were fed to the shaft and 980 kg/h thereof were fed to the lower part of the furnace. By means of two lances each as shown in FIGS. 2 and 3, 400 kg/h of acid sludge were fed in the shaft and 1200 kg/h of acid sludge were fed in the lower part of the furnace.

The annular temperature control passages 2 were held at 50° C. by means of water.

The atomizing fluid consisted of an air-oxygen mixture, which was fed under a pressure of 4 bars and at a rate of 0.5 $m^3$/kg of acid sludge.

The calorific values were:

| | |
|---|---|
| acid sludge | 13.6 MJ/kg |
| heavy fuel oil | 40.6 MJ/kg. |

Because the process conditions in the lower part of the furnace can well be ascertained quantitatively, they can be compared particularly clearly and tabulated.

| | Heavy fuel oil | Heavy fuel oil + acid sludge |
|---|---|---|
| Energy input (GJ/h) | 54.8 | 56.1 |
| Heavy fuel oil rate (kg/h) | 1350 | 980 |
| Acid sludge (kg/h) | — | 1200 |
| Air rate for combustion of heavy fuel oil ($m^3$/h) | 18600 | 13500 |
| Air rate for combustion of acid sludge ($m^3$/h) | — | 4800 |
| Oxygen addition rate for combustion of acid sludge ($m^3$/h) | — | 200 |
| Oxygen content of oxidizing fluid for combustion of acid sludge (% by volume) | — | 24.1 |
| Theoretical combustion temperature (°C.) | 1670 | 1675 |
| Exhaust gas rate ($m^3$/h) (due to combustion in lower part of furnace) | 19500 | 19900 |
| Exhaust gas/energy input ratio ($m^3$/GJ) | 355.8 | 354.7 |

In the table the total air rate is stated in part for the combustion of the heavy fuel oil and in part for the combustion of the acid sludge. The air rate can be ascertained for the combustion of the heavy fuel oil from the process in which only heavy fuel oil is burned by a suitable calculation in consideration of the decreased heavy-fuel-oil rate, and for the combination of the acid sludge by means of the above-mentioned formula for X if the following values are substituted:

| |
|---|
| $MO_2$ = 1.0 ($m^3$/kg) |
| $M_A$ = 1.66 ($m^3$/kg) |
| $H_{uS}$ = 13.6 (MJ/kg) |
| $H_{uB}$ = 40.6 (MJ/kg) |
| $S_{MA}$ = 14.4 ($m^3$/kg) |

In accordance therewith, the oxygen content of that part of the oxidizing fluid which is used for the combustion of the acid sludge was 24.1% by volume (X=0.241). The values are ascertained on the basis of the original operating conditions involving a combustion only of heavy fuel oil and 30% of excess air (corresponding to an excess of 30% oxygen in excess of what is theoretically required).

Particularly from a comparison of the theoretical combustion temperatures and of the respective exhaust gas-rate per energy input (last line of the table), it is apparent that the process conditions have not been essentially changed from those obtained when only heavy fuel oil is burned and that the flash smelting furnaces can be operated satisfactorily although a considerable quantity of heavy fuel oil has been replaced by acid sludge.

The total rate at which steam is produced (including that of the operation of the shaft of the flash smelting furnace) is 0.85 ton per ton of copper concentrate in both cases. This shows also that the method according to the invention does not result in detrimental differences.

We claim:

1. In a method by smelting a sulfur-containing metallurgical intermediate, or sulfide ore or sulfur-containing ore concentrate in the presence of an oxygen-containing gas and with a liquid petroleum fuel combusted at a flame temperature of at least 1500° C. in a combustion zone to form sulfur dioxide and a melt from the metallurgical intermediate, ore or ore concentrate, the improvement which comprises replacing part of said fuel by a calorifically equivalent quantity of sulfuric acid sludge containing at most 85% by weight inorganic constituents and introduced by a lance into the combustion zone.

2. The improvement defined in claim 1 wherein the oxygen content of the oxygen-containing gas is so selected with respect to the proportion of the acid sludge that the rate of exhaust gas per unit of heat is not higher than that which obtains when acid sludge does not replace a portion of the fuel.

3. The improvement defined in claim 1 wherein said acid sludge has a heat value related to its sulfuric acid content within the shaded region of the graph of FIG. 1.

4. The improvement defined in claim 1 wherein said acid sludge is burned together with heavy fuel oil.

5. The improvement defined in claim 4 wherein substantially equal quantities by weight per unit time of fuel oil and acid sludge are burned.

6. The improvement defined in claim 1 wherein the acid sludge is fed through a lance having an inner feed tube for the acid sludge surrounded by an annular passage, further comprising introducing a temperature control fluid into said passage to maintain a temperature of 30° to 80° C. therealong.

7. The improvement defined in claim 6 wherein an atomizing combustion-sustaining oxygen-containing gas is fed along an outer passage surrounding said annular passage.

8. The improvement defined in claim 1 wherein the oxygen-containing gas rate of flow is determined by the rate of flow with a given oxygen content corresponding to the combustion of a fuel oil at a rate in heat value required to maintain the flame condition and the same combustion-sustaining gas rate is used when the acid sludge is burned in place of a calorifically equivalent quantity of fuel oil.

* * * * *